United States Patent [19]

Jackson

[11] 4,196,653

[45] Apr. 8, 1980

[54] AUXILIARY FIRING MECHANISM

[75] Inventor: Theodore A. Jackson, Utica, Mich.

[73] Assignee: Cadillac Gage Company, Warren, Mich.

[21] Appl. No.: 935,440

[22] Filed: Aug. 21, 1978

[51] Int. Cl.[2] ..... F41D 11/02

[52] U.S. Cl. ..... 89/136

[58] Field of Search ..... 89/27 F, 127, 136

[56] References Cited

U.S. PATENT DOCUMENTS

| | | | |
|---|---|---|---|
| 2,527,715 | 10/1950 | Duplessis | 89/127 |
| 2,882,797 | 4/1959 | Musser | 89/136 |

*Primary Examiner*—Stephen C. Bentley

*Attorney, Agent, or Firm*—Reising, Ethington, Barnard, Perry & Brooks

[57] ABSTRACT

An auxiliary firing mechanism (26) used to actuate a tripper for a gun trigger includes a remote actuator (28) connected to the tripper by an elongated connector such as a cable (30) that is moved by the cooperable action of a control member (68) and a rotatably and axially movable actuator member (74) of the actuator. Camming surfaces (90,92) of the control member and the actuator member of the actuator move the control member from a first position to a second position against a spring bias (76) thereof in order to actuate the tripper and thereby trip the gun trigger whereupon the camming surface (92) of the actuator member moves out of engagement with the camming surface (90) of the control member in order to allow the control member to be moved back to the first position by its spring bias. Axial and rotational movement of the actuator member then again engages the camming surfaces of the control and actuator members in preparation for another actuation of the tripper. A manually movable lever (94) which preferably has a foot pedal (96) rotates the actuator member to provide the tripper actuation.

12 Claims, 6 Drawing Figures

AUXILIARY FIRING MECHANISM

TECHNICAL FIELD

This invention relates to an auxiliary firing mechanism for actuating a tripper for a gun trigger.

BACKGROUND ART

Automatic guns conventionally include an electro-mechanical tripper for tripping the gun trigger so as to allow actuation in a rapid succession that provides high-speed firing. In case of an electrical power shutdown, it is also desirable to have an auxiliary firing mechanism that can be manually actuated by either the gunner's foot or hand to provide firing. Of course, the rate at which the gun can be fired manually by the auxiliary firing mechanism is slower than the automatic firing but is preferable to being unable to fire the gun at all.

Certain automatic guns are mounted for recoil movement upon firing. Upon firing, the gun moves back against a bias that eventually moves the gun forward to its starting position ready for another firing. The gun trigger is mounted on the gun for movement therewith while the tripper that moves the trigger is mounted stationary. Automatic electro-mechanical actuation by the tripper is accomplished with a solenoid that is energized by an instantaneous electrical pulse to move a tripper member and then allow the tripper member to return to an unactuated conditon under a spring bias prior to the forward recoil gun movement in preparation for another round. Auxiliary firing mechanisms must also have some provision for returning the tripper member to an unactuated condition instantaneously so that the forward recoil movement does not jam the gun trigger with the tripper.

One prior auxiliary firing mechanism for a gun includes a tripper having an automatic solenoid trigger actuator and a remote foot pedal actuator connected to the tripper by a cable. Downward movement of the foot pedal moves a roller carried by a pivotal lever downwardly against an actuator member that is pivotally supported on a slide of the actuator. Pivoting of the actuator member on the slide is limited in the downward direction by a stop so that the roller moves the slide down as the pedal is depressed. The slide is connected to the cable so that the cable is moved by the downward movement of the slide until firing takes place. Upon firing, the roller slides downwardly off the actuator member so that a spring bias of the slide can return it upwardly to an unactuated condition. The foot pedal must be provided with an extension to allow the operator to move the pedal upwardly as the roller is likewise moved upwardly so that the actuator member pivots upwardly on the slide and allows the roller to move back into engagement with its upper side ready for another actuation of the tripper.

DISCLOSURE OF INVENTION

An object of the present invention is to provide an improved auxiliary firing mechanism for manually actuating a tripper for a gun trigger.

In carrying out the above object and other objects of the invention, the auxiliary firing mechanism includes an actuator located at a remote location from the tripper and connected thereto by an elongated connector such as a cable that is actuated by cooperation between a movable control member on a housing of the actuator and an actuator member that is supported on the housing for rotatable and axial movement. Camming surfaces on the control member and the actuator member move the actuator member from a first position to a second position against a spring bias in order to move the cable to actuate the tripper and trip the gun trigger whereupon the camming surface of the actuator member moves out of engagement with the camming surface of the control member so that the spring bias of the control member moves it back to the first position. Axial and rotational movement of the actuator member subsequent to the firing again engages the camming surfaces of the control and actuator members in preparation for another actuation of the tripper. Rotation of the actuator member is provided by a manually movable lever which preferably has a foot pedal.

Openings in the actuator housing provide a slideway that slidably supports the control member for rectilinear movement between its first and second position. An aperture in the control member defines the camming surface thereof and receives a cam of the actuator member in preparation for firing. The camming surface of the actuator member is defined on the cam. A shaft of the actuator member supports the cam and is mounted by the actuator housing for the rotational and axial movement that allows the tripping of the gun trigger and the actuator member movement in preparation for a subsequent actuation of the tripper. After firing, the actuator member is moved axially in one direction to move the cam from a first portion of the control member aperture to a second enlarged portion thereof where the cam is free to rotate prior to axial movement in the other direction so as to engage the camming surfaces in preparation for another actuation of the tripper.

A coupling of the control member is connected to the cable and is received within a helical spring that biases the control member. One end of the helical spring is seated by the coupling while the other end of the helical spring is seated by the actuator housing so as to provide the spring bias that normally urges the control member to its unactuated first position. A spring biased connection of the coupling secures the cable and allows an increase in the effective length thereof to prevent damage when attempted foot pedal movement is resisted by a jammed gun. Prior to firing, the foot pedal lever is located by a spring and stop positioner in an unactuated position ready for actuation and firing. Another stop limits the extent of pedal lever rotation after firing.

The objects, features, and advantages of the present invention are apparent from the following description of the best mode for carrying out the invention when taken in connection with the accompanying drawings.

BEST MODE FOR CARRYING OUT THE INVENTION

Figure 1:
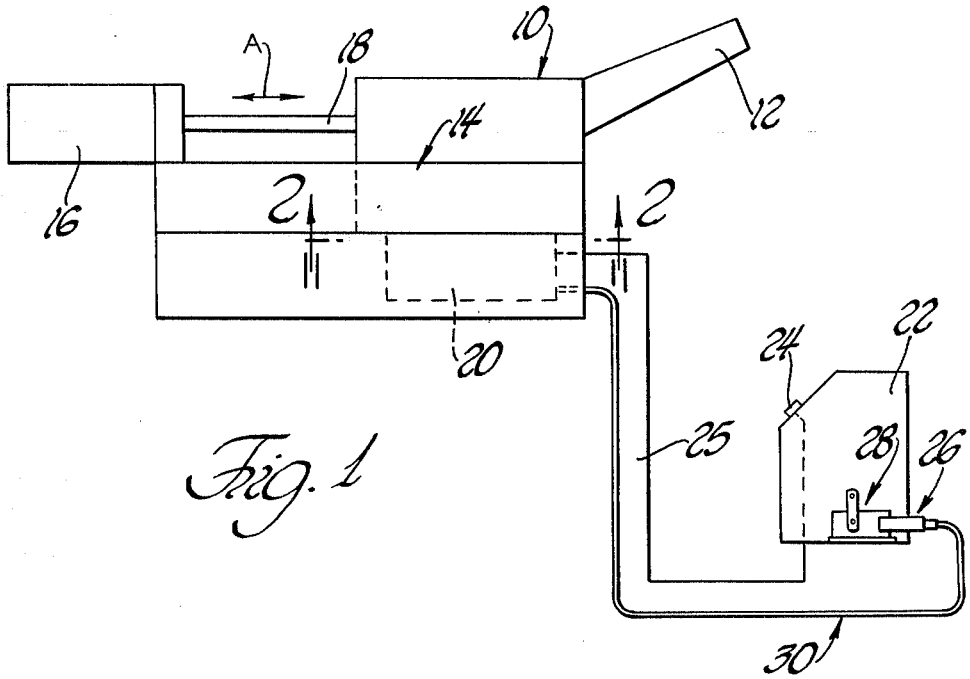
FIG. 1 is an elevation view of a gun having an auxiliary gun firing mechanism constructed in accordance with the present invention.

Referring to FIG. 1, a gun indicated collectively by 10 and having a barrel 12 is shown mounted on a gun slideway support 14 for movement to the left and the right as illustrated by arrow A. A recoil cylinder 16 which is fixedly supported on the slideway support 14 in any suitable manner includes a piston connecting rod 18 that is connected to the gun 10 so as to control the gun movement during recoil action after firing. Upon firing, the gun 10 is moved rearwardly to the left against the bias of cylinder 16 which eventually returns the gun forwardly to the right ready for another firing. Actuation of a gun trigger tripper 20 fires the gun in a manner which is more fully hereinafter described. At a remote location from the tripper 20, a gunner control panel 22 has a push button 24 connected to the tripper by an electrical line 25 in order to provide automatic firing. An auxiliary firing mechanism 26 constructed in accordance with the present invention includes an actuator 28 at the control panel 22 and an elongated connector that preferably is embodied by a flexible cable 30 having one end secured to the tripper and another end secured to the actuator. Manual operation of the actuator 28 which is preferably accomplished by foot manipulation actuates the tripper 20 to fire the gun 10 in case of a power failure or any other problem connected with the automatic firing of the gun.

With additional reference to FIGS. 2 and 3, the tripper 20 includes a housing 31 mounted on the gun slideway support 14 in any suitable manner below the gun 10 whose button trigger 32 is moved upwardly against the bias of a spring 34 (FIG. 3) to fire the gun in a conventional manner. A pivotal tripper member 36 is supported by a pin 38 and biased in a counterclockwise direction as shown in FIG. 3 by a spring 40 whose action thus normally prevents tripping of the trigger 32. A slidable tripper member 42 supported on the tripper housing 31 by a pair of spaced slides 44 is used to provide clockwise pivotal movement of the tripper member 36 in order to trip the trigger 32 by the action of an electro-mechanical solenoid 46 or the operation of the auxiliary firing mechanism 26.

Figure 2:
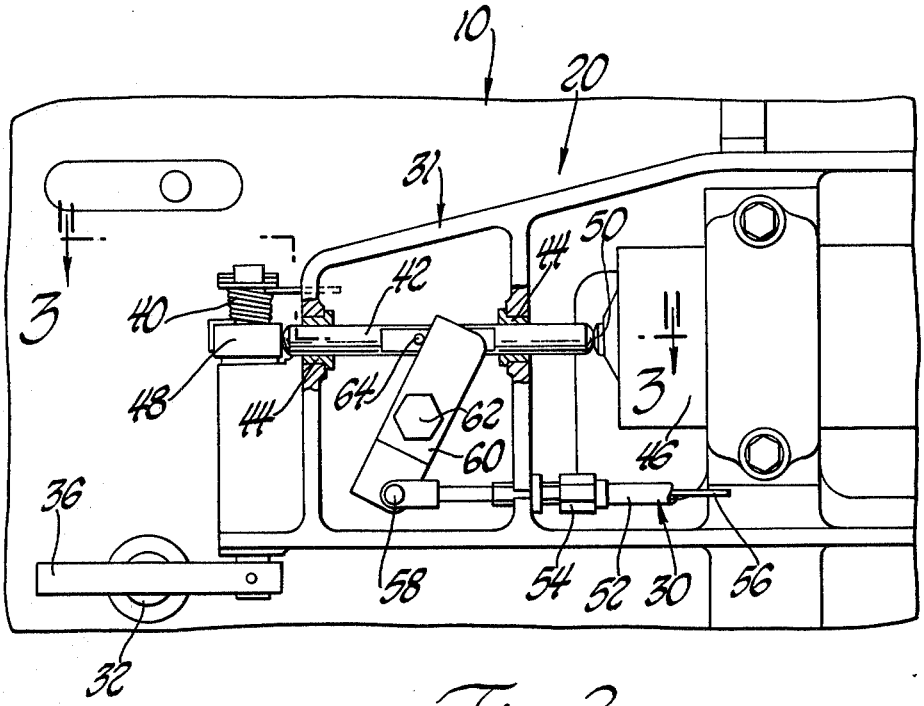
FIG. 2 is a bottom plan view taken partially in section along line 2—2 of FIG. 1 through a tripper that fires the gun either electro-mechanically or by the auxiliary firing mechanism.
Figures 3, 4:
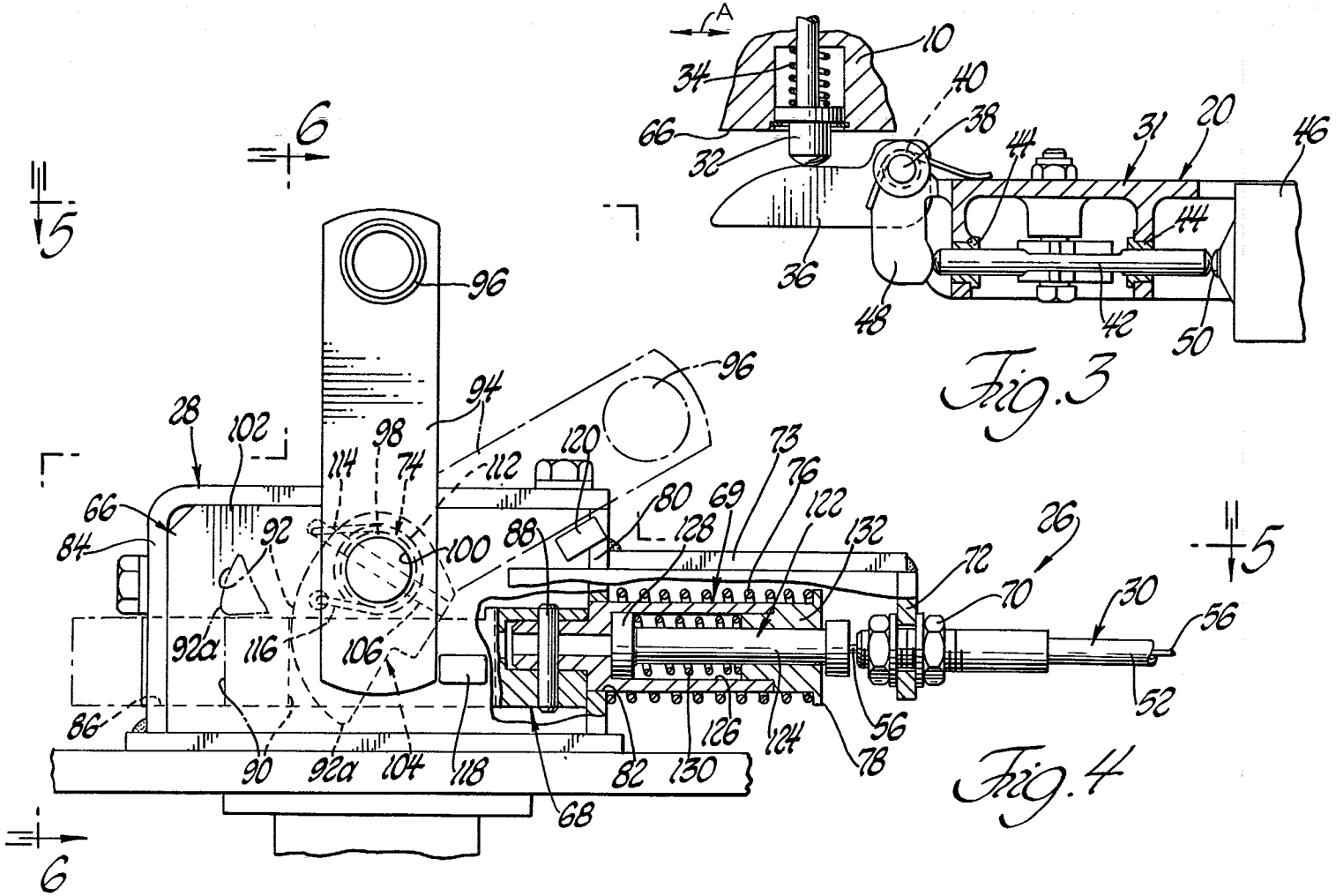
FIG. 3 is an elevation view taken in section along line 3—3 of FIG. 2 through the tripper and illustrating the manner in which the gun trigger is tripped by the tripper.
FIG. 4 is an enlarged view of a portion of FIG. 1 and illustrates an actuator of the auxiliary firing mechanism.

With continuing reference to FIGS. 2 and 3, one end of the tripper member 42 is engaged with a downwardly extending leg 48 of the pivotal tripper member 36. The other end of tripper member 42 is engaged by a plunger 50 of the solenoid 46 such that movement of the plunger to the left slides the tripper member 42 in order to pivot the tripper member 36 against the bias of spring 40 and move the trigger 32 upwardly to fire the gun. A shroud 52 of cable 30 is secured to the tripper housing 31 by a connector assembly 54 and receives a flexible cable wire 56 that is slidably movable within the shroud along the length of the cable. A pivotal connector 58 secures one end of the cable wire 56 to a first end of a lever tripper member 60 that is pivoted on the housing 31 by a connector bolt 62. A second end of the tripper member 60 engages a pin 64 on the intermediate portion of the tripper member 42 as best seen in FIG. 2. Pulling action of the cable wire 56 to the right pivots the tripper member 60 counterclockwise to move the tripper member 42 to the left and thereby fire the gun by moving the pivotal tripper member 36 in the manner described above in connection with the operation of solenoid 46. When the solenoid 46 is actuated, the movement of the tripper member 42 disengages the pin 64 from the adjacent end of the tripper member 60 to allow the electro-mechanical firing of the gun. Upon manual firing of the gun by the auxiliary firing mechanism 26, the tripper member 42 is moved to the left while its right end disengages the solenoid plunger 50.

With combined reference to FIGS. 1 and 3, gun 10 moves to the left after it is fired and the nose of the tripper member 36 is then located in engagement with the lower surface 66 (FIG. 3) of the gun horizontally aligned with the trigger 32 which moves downwardly under the bias of spring 34 as soon as the gun movement carries the trigger to the left of the tripper member 36. Upon movement of the gun 10 back toward the right under the action of the recoil cylinder 16 shown in FIG. 1, it is important that the tripper member 36 is first moved downwardly out of the way of trigger 32 so that the trigger does not jam sideways against the nose of the tripper member. In order to provide such movement, the solenoid plunger 50 is spring biased toward the right and the solenoid 46 is supplied an instantaneous electrical surge so that the plunger moves back toward the right and the spring 40 can move the pivotal tripper member 36 downwardly as soon as the trigger 32 is tripped. Likewise, operation of the auxiliary firing mechanism 26 also provides rapid downward movement of the tripper member 36 after tripping of the trigger 32 in a manner which is hereinafter described.

Figure 5:
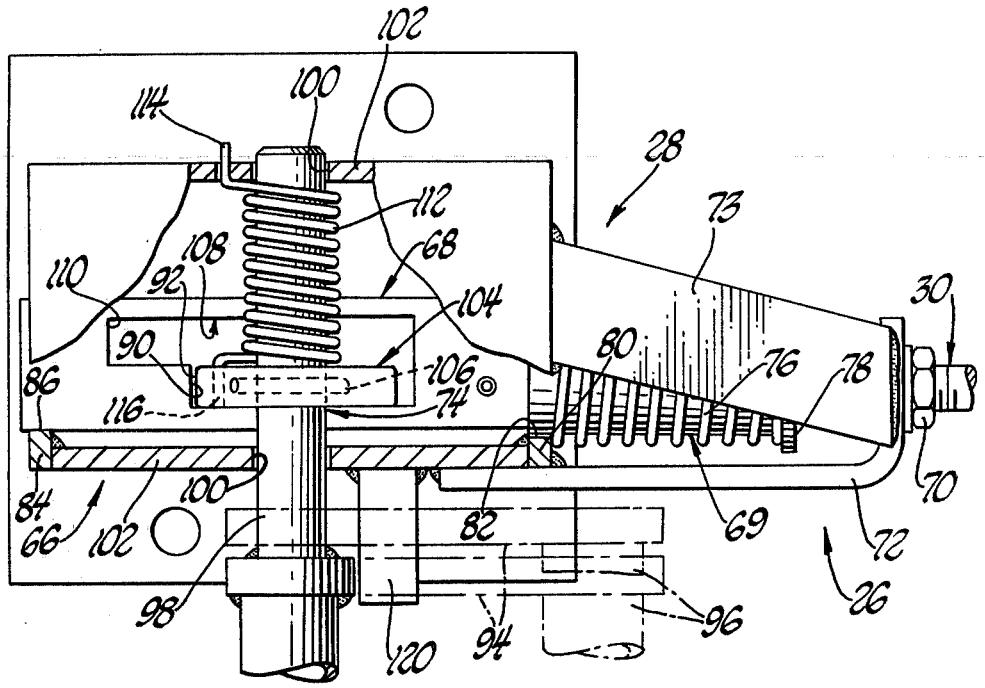
FIG. 5 is a top plan view taken along line 5—5 of FIG. 4 and shows the actuator with a housing thereof partially broken away.
Figure 6:
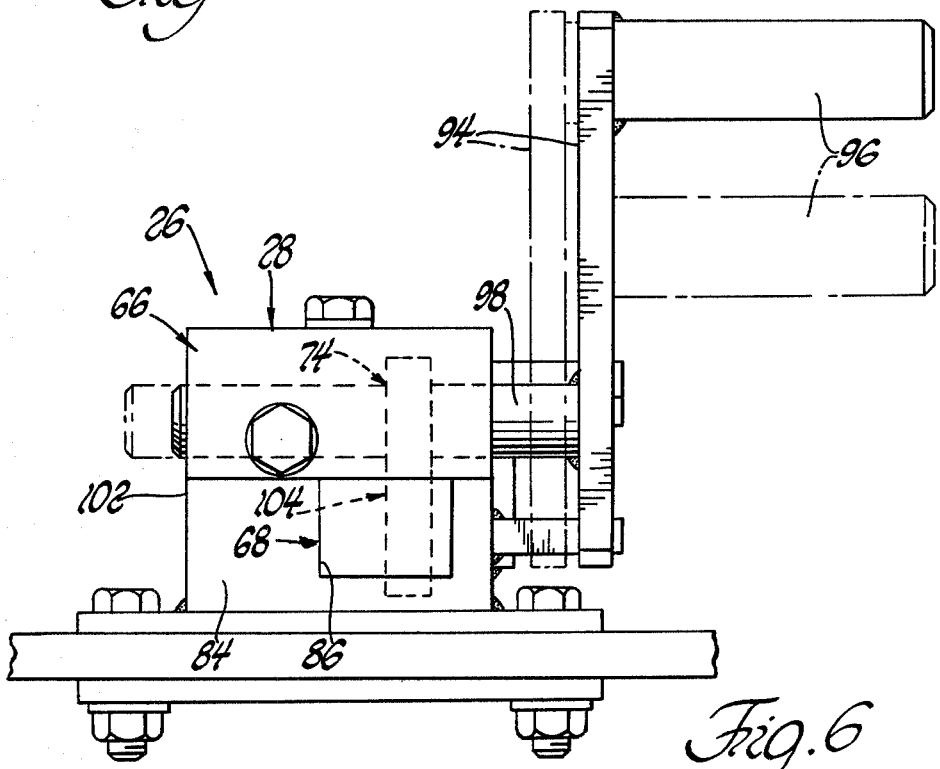
FIG. 6 is an end view of the actuator taken along line 6—6 of FIG. 4.

Referring now to FIGS. 4, 5, and 6, the actuator 28 for the auxiliary firing mechanism includes a housing 66 of a suitable hollow construction. A control member 68 of the actuator is supported by the housing 66 and connected by a coupling 69 (FIG. 4) to the cable wire 56 while the cable shroud 52 is secured by a connector assembly 70 to an L-shaped plate extension 72 that is secured to the housing and supported by a diagonal brace 73. An actuator member 74 is rotatably and axially supported by the actuator housing 66 for movement between the solid and phantom line indicated positions shown in FIGS. 4 and 6 in order to provide movement of the control member 68 so as to move the cable wire 56 and thereby actuate the tripper that trips the gun trigger in the manner previously described. Coupling 69 is received within a helical biasing spring 76 of the control member. One end of the spring 76 is seated against an annular flange 78 on the right end of the coupling 69 while the other end of the spring is seated against a housing end wall 80 whose opening 82 slidably receives the coupling for movement to the left and the right. Another end wall 84 of the actuator housing 66 includes an opening 86 that receives the left end of the control member 68. Housing openings 82 and 86 cooperatively provide a slideway that supports the control member 68 for rectilinear movement between the unactuated first position shown by solid line representation and the cable actuated second position shown by phantom line representation in FIG. 4. Spring 76 normally biases the control member 68 to the right so that its right end engages the end wall 80 adjacent the lower edge of its opening 82 at the juncture where the coupling 69 is secured by a pin 88.

Control member 68 includes a camming surface 90 that is engaged by a camming surface 92 of the actuator member 74 as shown in FIG. 4 prior to actuation of the cable. A pivotal lever 94 is secured to the actuator member 74 and preferably includes a foot pedal 96 for providing clockwise actuation that moves the control member 68 to the left in order to pull the cable wire 56. When the wire 56 has been pulled sufficiently far to trip the gun trigger in the manner previously described, the nose 92*a* of the camming surface moves upwardly out of engagement with the camming surface 90 on the control member and thereby allows the helical spring 76 to return the control member back to its unactuated position as the control member slides under the camming surface nose. An axial movement of the actuator member 74 in one direction followed by a counterclockwise rotational movement and a subsequent reverse axial movement in the other direction then again engages the camming surfaces 90 and 92 ready for another actuation of the tripper.

As seen best in FIG. 5, actuator member 74 includes a shaft 98 that is supported for rotational and axial movement by openings 100 within side walls 102 of the actuator housing. A cam 104 of the actuator member 74 is fixed by a pin 106 to shaft 98 and defines the camming surface 92 which actuates movement of the control member 68 to the left. A vertical aperture 108 through the control member 68 includes a first portion that defines the camming surface 90 of the control member adjacent the side wall 102 nearest the pedal lever 94 and also includes a second axially spaced portion of a larger size nearest the other side wall 102. An extension 110 of the control member aperture 108 extends toward the left from the control member camming surface 90 in order to allow movement of the actuator member back to a ready position for firing after each actuation of the tripper.

Prior to each actuation of the tripper 20 by the actuator 28 shown in FIGS. 4 through 6, the lever 94 is located in the solid line position of FIG. 4 with the cam 104 located with its camming surface 92 aligned with the camming surface 90 of the control member 68. A spring 112 that encircles the actuator member shaft 98 has one end 114 secured to the one housing side wall 102 and another end 116 secured to the cam 104. Spring 112 biases the actuator member 94 so that the lower end of the lever 94 is engaged with a housing mounted stop 118 in an unactuated condition. Spring 112 and stop 118 thus provide a positioner for locating the pedal lever 96 in its unactuated condition. Downward movement of the pedal lever 96 by foot actuation pivots the lever to the phantom line indicated actuated position against another stop 120 in order to pull the cable wire 56 to actuate the tripper as previously described. As the nose 92*a* of the camming surface 92 moves over the upper end of the camming surface 90 on the control member, the spring 76 returns the control member to its solid line indicated position of FIG. 4 so that the tripper member 36 returns counterclockwise under the action of spring 40 out of the way of the gun trigger 32 as the gun is returned to its firing position under the recoil movement previously described. Lever 94 is then moved axially from the solid line position shown in FIG. 6 toward the housing to the phantom line position shown so that the nose of the cam surface moves above the extension 110 in the aperture. Spring 112 is compressed as this axial movement takes place and, as the cam moves over the aperture extension 110, pivots the actuator member 74 and the lever 94 counterclockwise as shown in FIG. 4 back to the unactuated position. Foot manipulation of the pedal 96 then moves the lever and the actuator member axially back to the solid line position of FIG. 6 to again align the camming surfaces 90 and 92 as shown by FIG. 5 in preparation for another actuation of the tripper.

A spring biased connector 122 of the coupling 69 is shown in FIG. 4 and allows the effective length of the cable wire 56 to be increased in case the lever 94 is actuated when the gun trigger is jammed. Connector 122 includes a connection member 124 secured to the adjacent end of the cable wire 56 and slidably received within an opening 126 in coupling 69. The left end of connector member 124 includes an annular flange 128 that seats the left end of a helical spring 130 which extends about the connector member. The right end of spring 130 is seated against the fitting 132 which closes the coupling opening 126 and defines the flange 78 that seats the biasing spring 76. Spring 130 is stronger than the spring 76 so that the control member 68 normally moves to pull the cable 56 upon clockwise pivoting of lever 94. However, if the gun trigger 32 shown in FIG. 3 is jammed, the spring 130 deflects to allow the connector member 124 to slide within the coupling 69 and through the fitting 132 in order to prevent excessive tensioning of the cable wire 56 and possible damage by either elastic deformation or fracture.

While the best mode for carrying out the invention has herein been described in detail, those familiar with the art will recognize various alternative designs and embodiments for practicing the present invention and defined by the following claims.

What is claimed is:

1. An auxiliary firing mechanism for actuating a tripper for a gun trigger, said mechanism comprising: an actuator located at a remote location from the tripper; the actuator including a housing having a control member mounted thereby for movement from a first position to a second position; said control member having a camming surface; an elongated connector extending between the actuator and the tripper so as to trip the gun trigger upon movement of the control member from the first position to the second position; means for biasing the control member to the first position; an actuator member mounted on the actuator housing for rotational and axial movement; said actuator member having a camming surface that engages the camming surface of the control member to move the control member from the first position thereof to the second position thereof upon actuator member rotation whereupon the camming surface of the actuator member moves out of engagement with the camming surface of the control member as the tripper trips the gun trigger in order to allow the biasing means to return the control member to its first position; the actuator member being movable axially and rotationally to subsequently engage the camming surfaces of the control and actuator members in preparation for another actuation of the tripper; and a manually movable lever for rotating the actuator member to provide the actuation of the tripper.

2. A mechanism as in claim 1 wherein the actuator housing includes a slideway that slidably supports the control member for rectilinear movement between its first and second positions.

3. A mechanism as in claim 2 wherein the control member includes an aperture that defines the camming surface thereof and wherein the actuator member includes a cam defining the camming surface thereof, and said aperture in the control member receiving the cam of the actuator member during the engagement of the camming surfaces that actuates the tripper.

4. A mechanism as in claim 3 wherein the aperture in the control member includes first and second axially spaced portions, said first aperture portion of the control member being partially defined by the camming surface thereof, and said second aperture portion receiving the cam of the actuator member upon axial movement thereof after tripping of the trigger so as to allow the rotation and subsequent reverse axial movement of the actuator member that engages the camming surfaces of the control and actuator members in preparation for another actuation of the tripper.

5. A mechanism as in claims 1 or 4 wherein the biasing means comprises a spring that extends between the actuator housing and the control member to provide the biasing thereof to the first position.

6. A mechanism as in claim 5 wherein the control member including a coupling that provides securement thereof to the connector, and the biasing spring being of a helical shape that receives the coupling.

7. A mechanism as in claim 6 wherein the coupling includes a spring biased connection to the connector for allowing an increase in the effective length of the connector in order to prevent damage thereto.

8. A mechanism as in claims 1 or 4 wherein the lever that rotates the actuator member includes a foot pedal.

9. A mechanism as in claim 8 further including a spring and stop positioner for normally positioning the lever in an unactuated position.

10. An auxiliary firing mechanism for actuating a tripper for a gun trigger, said mechanism comprising: an actuator located at a remote location from the tripper; the actuator including a housing having a control member slidably mounted thereby for movement from a first position to a second positon; said control member having an aperture that defines a camming surface; an elongated connector including a flexible cable connected to the tripper; a coupling that secures the cable to the control member such that movement thereof from the first position to the second position trips the gun trigger; a helical spring that receives the coupling and has one end seated thereby and another end seated by the actuator housing so as to bias the control member to the first position; an actuator member including a shaft mounted on the actuator housing for rotational and axial movement; said actuator member having a cam which is supported by the shaft and received within the aperture in the control member in preparation for actuation of the tripper; said cam including a camming surface that engages the camming surface of the control member to move the control member from the first position thereof to the second position thereof upon actuator member rotation whereupon the camming surface of the actuator member cam moves out of engagement with the camming surface of the control member as the tripper trips the gun trigger in order to allow the helical spring to return the control member to its first position; the actuator member being movable axially in one direction and then rotationally prior to axial movement in the other direction so as to subsequently engage the camming surfaces of the control and actuator members in preparation for another actuation of the tripper; and a manually movable lever including a foot pedal for rotating the actuator member to provide the actuation of the tripper.

11. An auxiliary firing mechanism for tripping a gun trigger, said mechanism comprising: a tripper including a solenoid for tripping the gun trigger and a tripper member whose movement trips the gun trigger; an actuator located at a remote location from the tripper; the actuator including a housing having a control member slidably mounted thereby for movement from a first position to a second position; said control member having an aperture that defines a camming surface; an elongated connector including a flexible cable connected to the tripper member of the tripper; a coupling that secures the cable to the control member such that movement thereof from the first position to the second position moves the cable to trip the gun trigger; a helical spring that receives the coupling and has one end seated thereby and another end seated by the actuator housing so as to bias the control member to the first position; an actuator member including a shaft mounted on the actuator housing for rotational and axial movement; said actuator member having a cam which is supported by the shaft and received within the aperture in the control member in preparation for actuation of the tripper; said cam including a camming surface that engages the camming surface of the control member to move the control member from the first position thereof to the second position thereof upon actuator member rotation whereupon the camming surface of the actuator member cam moves out of engagement with the camming surface of the control member as the tripper trips the gun trigger in order to allow the helical spring to return the control member to its first position; the actuator member being movable axially in one direction and then rotationally prior to axial movement in the other direction so as to subsequently engage the camming surfaces of the control and actuator members in preparation for another actuation of the tripper; a manually movable lever including a foot pedal for rotating the actuator member to provide the actuation of the tripper; and a spring and stop positioner for normally locating the pedal lever in an unactuated position.

12. An auxiliary firing mechanism for actuating a tripper for a gun trigger, said mechanism comprising: an actuator located at a remote location from the tripper; the actuator including a housing having a control member slidably mounted thereby for movement from a first position to a second position; said control member having an aperture including a first portion that has a camming surface and a second portion spaced from the first aperture portion; an elongated connector including a flexible cable connected to the tripper; a coupling that secures the cable to the control member such that movement thereof from the first position to the second position trips the gun trigger; a helical spring that receives the coupling and has one end seated thereby and another end seated by the actuator housing so as to bias the control member to the first position; the coupling including a spring biased connection to the cable for allowing an increase in the effective length thereof in order to prevent damage thereto; an actuator member including a shaft mounted on the actuator housing for rotational and axial movement; said actuator member having a cam supported by the shaft and received within the aperture in the control member in preparation for actuation of the tripper; said cam including a camming surface that engages the camming surface of the control member to move the control member from the first position thereof to the second position thereof upon actuator member rotation whereupon the camming surface of the actuator member cam moves out of engagement with the camming surface of the control member as the tripper trips the gun trigger in order to allow the helical spring to return the control member to its first position; the actuator member being movable axially in one direction from the first aperture portion to the second aperture portion and then rotationaly prior to axial movement in the other direction from the second aperture portion to the first aperture portion so as to subsequently engage the camming surfaces of the control and actuator members in preparation for another actuation of the tripper; a manually movable lever including a foot pedal for rotating the actuator member to provide the actuation of the tripper; and a spring and stop positioner for normally positioning the pedal lever in an unactuated position.

* * * * *